US006106405A

United States Patent [19]

Fox

[11] Patent Number: 6,106,405

[45] Date of Patent: Aug. 22, 2000

[54] APPARATUS FOR GOLF BALL SET-UP

[76] Inventor: Robert Fox, 7773A Victoria Drive, Vancouver, British Columbia, Canada, V5P 3Z9

[21] Appl. No.: 09/253,925

[22] Filed: Feb. 22, 1999

Related U.S. Application Data

[63] Continuation-in-part of application No. 09/084,406, May 26, 1998, abandoned.

[51] Int. Cl.[7] ..... A63B 57/00

[52] U.S. Cl. ..... 473/137; 473/133

[58] Field of Search ..... 473/132–137

[56] References Cited

U.S. PATENT DOCUMENTS

| | | | |
|---|---|---|---|
| 1,545,959 | 7/1925 | Huyler | 473/137 |
| 1,888,256 | 11/1932 | Baumgartner | 473/137 |
| 2,127,282 | 8/1938 | Beckett | 473/137 |
| 2,948,536 | 8/1960 | Koener | 473/137 |
| 3,112,932 | 12/1963 | Marsh | 473/136 |
| 4,017,087 | 4/1977 | Bruno . | |
| 4,265,453 | 5/1981 | Loof | 473/137 |
| 4,815,744 | 3/1989 | Diamandis . | |
| 4,957,296 | 9/1990 | Turnidge et al. | 473/137 |
| 5,022,657 | 6/1991 | Bussiere et al. | 473/137 |
| 5,282,629 | 2/1994 | Eckstein . | |
| 5,330,194 | 7/1994 | Copeland . | |
| 5,390,931 | 2/1995 | Chiasson . | |
| 5,611,737 | 3/1997 | Rau et al. | 473/137 |

*Primary Examiner*—Steven Wong
*Attorney, Agent, or Firm*—David S. Thompson

[57] ABSTRACT

A golf ball set-up apparatus 100 provides a tee assembly 600 which slides within a set-up tube 350 between a lower position wherein a ball advancing from a ball supply trough 410 is mounted on the tee 610 and an upper position wherein the ball is elevated to a position suitable for driving by the golfer. The tee assembly is moved between upper and lower positions by a lift arm assembly 300, which is in turn driven by a driving lever extension 250 extending from the driving lever assembly 200. Pressure of a golf club moves the driving lever assembly between an at-rest position, to a position wherein the tee assembly is fully lowered. When the tee assembly is lowered, a ball stop assembly 500 engages the column of in-coming golf balls, preventing their advancement. When the golf club is removed, a return weight assembly 450 returns the set-up apparatus to the at-rest configuration, with a movement that is damped by the air break assembly 550. With the tee assembly in the raised position, the ball stop assembly is disengaged, allowing the column of golf balls to advance.

2 Claims, 4 Drawing Sheets

APPARATUS FOR GOLF BALL SET-UP

CROSS-REFERENCES

This application is a continuation in part of application Ser. No. 09/084,406, having filing date May 26, 1998, which is hereby abandoned.

BACKGROUND

Golf ball set-up devices are known. However, known set-up devices have generally been prone to inaccurate operation, in that many have been inconsistent or ineffective in correctly teeing the ball. Over-complexity has also been an issue, with many golf ball set-up devices having a high parts-count and an associated low mean time between failures. Many set-up devices are also difficult or inconvenient to operate, and may cause some wear-and-tear on the golfer's clubs, where it is required to pull on rods, handles or hooks with an outstretched club.

Due to the number of moving parts required, it is typical for a golf ball set-up apparatus to suffer part failure due to friction between adjacent parts. Due to the tight tolerances that are typically required to correctly set up the golf ball, slight wear can result in a failure to function properly. Similarly, as parts begin to wear, friction may increase as part fit and dimensions are altered, and friction may increase, hastening failure and causing the mechanism to stick in certain positions.

For the foregoing reasons, there is a need for a golf ball set-up apparatus that can easily, accurately and consistently set-up a golf ball with a minimum of cost, effort and ball-handling errors.

SUMMARY

The present invention is directed to an apparatus that satisfies the above needs. The apparatus for golf ball set-up of the present invention provides some or all of the following structures.

(A) A driving lever, carrying a padded button on an upper end and pivoting on a supporting frame about a generally centrally located pivot, is movable between a first resting position in which the upper portion of the lever is extended forwardly and a second position by pushing on the padded button with the head of a golf club.

(B) A driving lever extension, having a rearward end attached to a lower end of the driving lever moves in response to movement of the driving lever.

(C) A lift arm assembly provides similar left and right arms which pivot on the frame. The lift arm assembly pivots, at the intersection of the forward and rear arm segments, between a first resting position in which the forward end of the forward segment is raised, and a second position in which the forward end of the forward segment is lowered. The lift arm is driven between the first and second positions by the forward end of the driving lever extension, which is attached to the end of a perpendicular segment which is attached to one of the lift arms.

(D) A ball set-up tube, defining diametrically opposed vertical slots oriented in a length-wise direction, an upper opening and a side opening, has an inside diameter slightly greater than a golf ball.

(E) A ball supply trough delivers golf balls from a ball storage hopper into the side opening of the set-up tube.

(F) A return weight assembly, carried between the the rear segment of the arms of the lift arm assembly, biases the lift arm assembly into its resting position wherein the forward segments of the arms are raised.

(G) A ball stop assembly is movable between a resting first position, wherein the flow of golf balls through the ball supply trough is blocked, and a second position wherein the lift arm assembly engages the ball stop assembly, moving it to a position wherein the movement of the golf balls in the ball supply trough is allowed.

(H) An air brake assembly, having one end fixed and one end carried by the lift arm assembly, reduces the speed at which the lift arm assembly moves.

(I) A tee assembly is moved by the lift arm assembly between an upper and a lower position within the ball set-up tube. The tee assembly moves a golf ball from a lower position within the set-up tube to a position wherein the golf ball extends from the upper opening defined in the set-up tube where it may be struck by the golf club.

It is therefore a primary advantage of the present invention to provide a novel apparatus for golf ball set-up having a return weight lever assembly which is damped by an air brake to smoothly raise the tee assembly having a mounted golf ball.

Another advantage of the present invention is to provide a novel apparatus for golf ball set-up having a driving lever that is actuated by pressure on a padded button, and which therefore allows manual operation without bending over, scratching a club or undue waiting or delay.

A still further advantage of the present invention is to provide a novel apparatus for golf ball set-up having a lift arm assembly having left and right lift arms which lift a tee assembly in a manner that prevents binding and reduces wear and tear.

DRAWINGS

These and other features, aspects, and advantages of the present invention will become better understood with regard to the following description, appended claims, and accompanying drawings where:

DESCRIPTION

Figure 1:
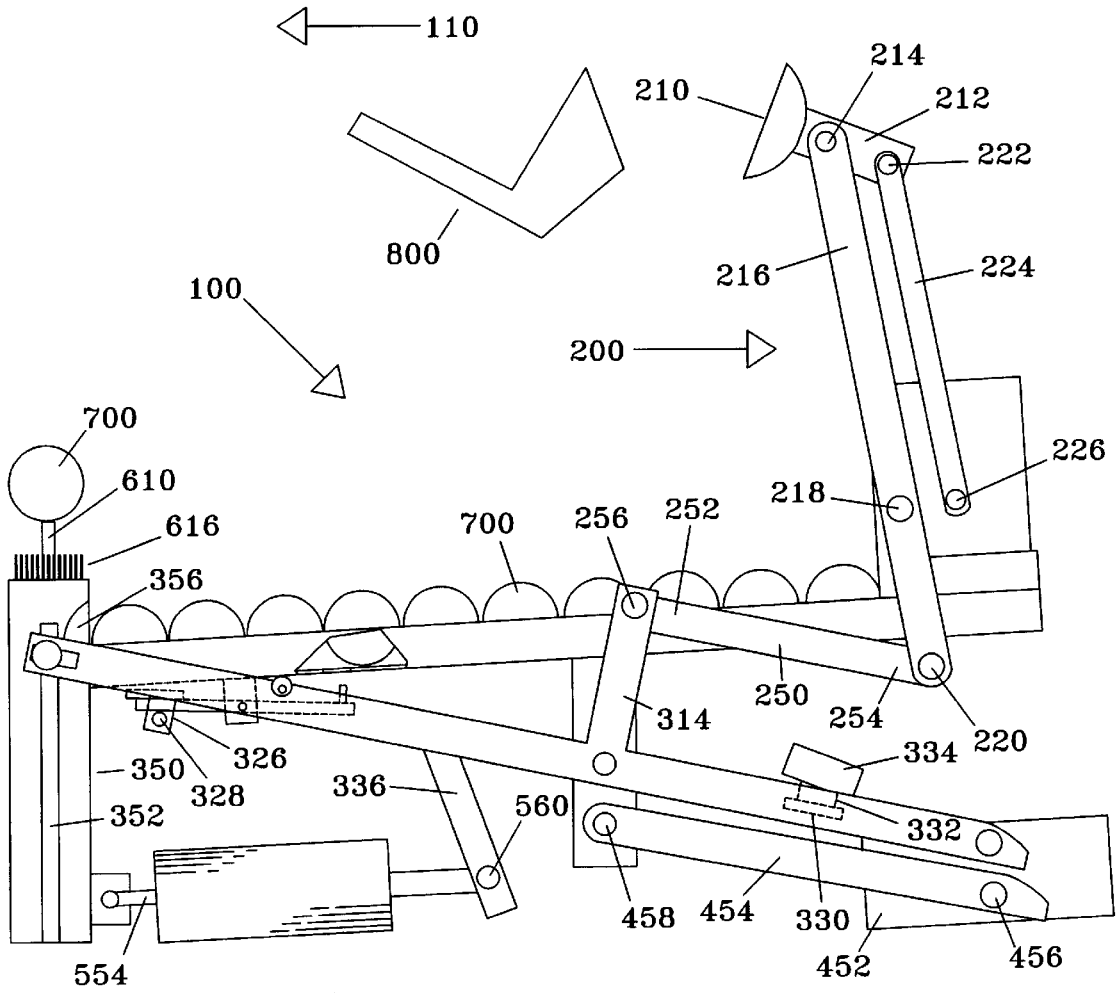
FIG. 1 is a somewhat diagrammatic side view of a version of the golf ball set-up apparatus of the invention, in the tee assembly is in the raised position.
Figure 2:
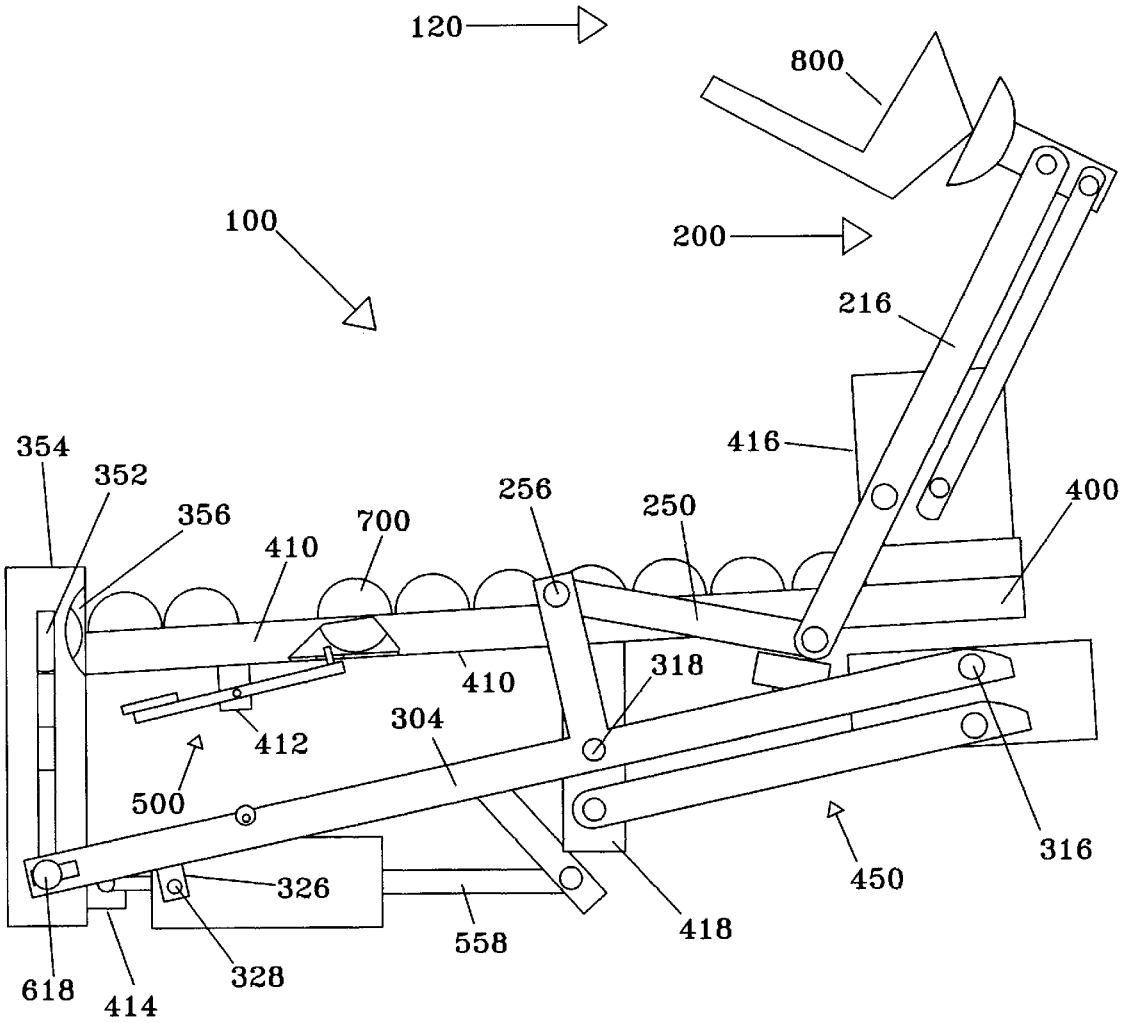
FIG. 2 is a somewhat diagrammatic side view of the golf ball set-up of FIG. 1, wherein the tee assembly is in the lowered position.
Figure 3:
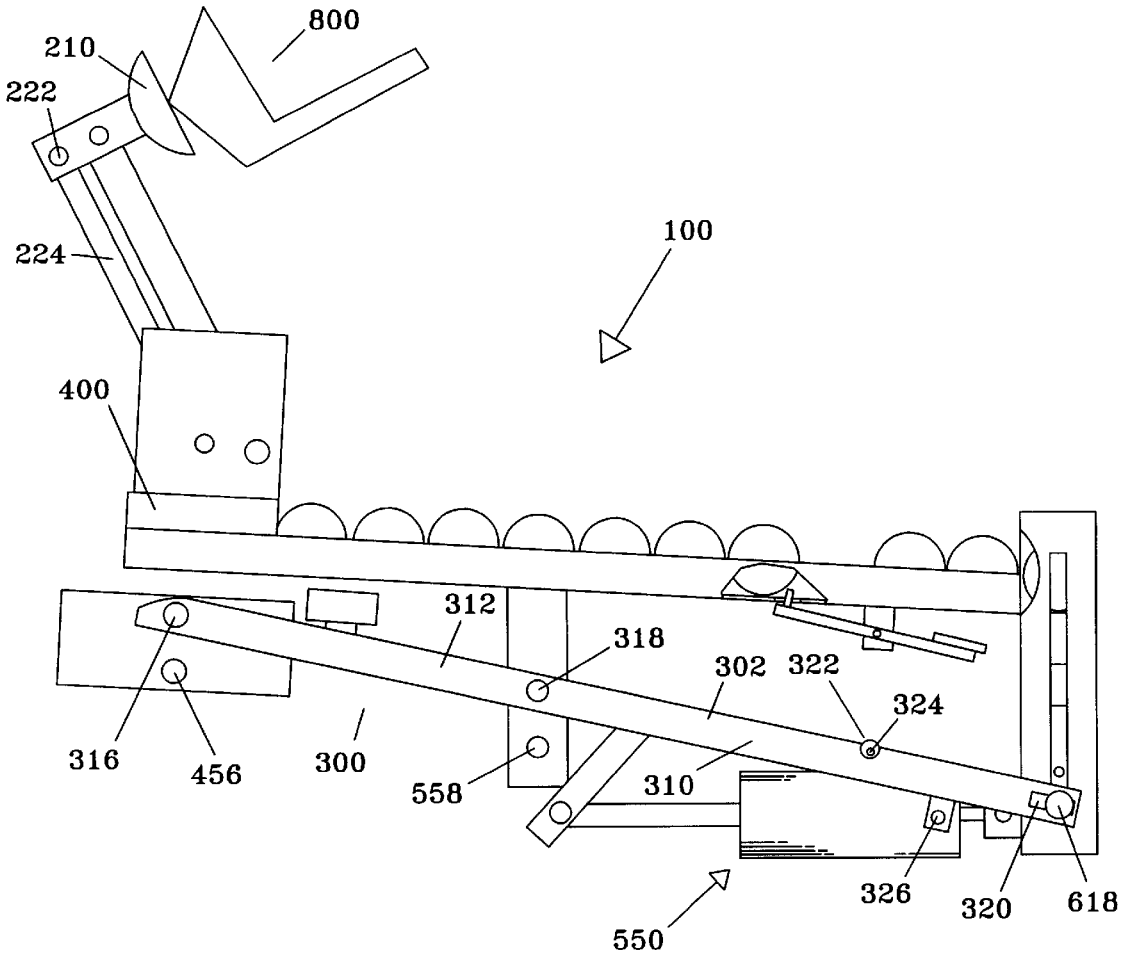
FIG. 3 is a view similar to that of FIG. 1, but taken from the other side.

Referring in particular to FIGS. 1 and 2, a golf ball set-up apparatus 100 constructed in accordance with the principles of the invention is seen. The apparatus provides a tee assembly 600 which slides within a set-up tube 350 between a lower position wherein a ball advancing from a ball supply trough 410 is mounted on the tee 610 and an upper position wherein the ball is elevated to a position suitable for driving by the golfer. The tee assembly is moved between upper and lower positions by a lift arm assembly 300, which is in turn driven by a driving lever extension 250 extending from the driving lever assembly 200. Pressure of a golf club moves the driving lever assembly between an at-rest position seen in FIG. 1, to the position seen in FIG. 2, wherein the tee assembly is fully lowered. When the tee assembly is lowered, a ball stop assembly 500 engages the column of incoming golf balls, preventing their advancement. When the golf club is removed, a return weight assembly 450 returns the set-up apparatus to the at-rest configuration, with a movement that is damped by the air break assembly 550. With the tee assembly in the raised position, the ball stop assembly is disengaged, allowing the column of golf balls to advance.

Referring to FIGS. 1 through 4, it can be seen that the tee assembly 600 slides within the set-up tube 350. In a lower position, seen in FIG. 2, the tee 610 is slightly below the side opening 356 in the set-up tube 350, allowing a ball from the ball supply tube to advance and move onto the tee. In an upper position, seen in FIG. 1, the cylindrical slider 612 blocks additional balls from the ball supply tube 400 from entering the set-up tube.

Figure 5:
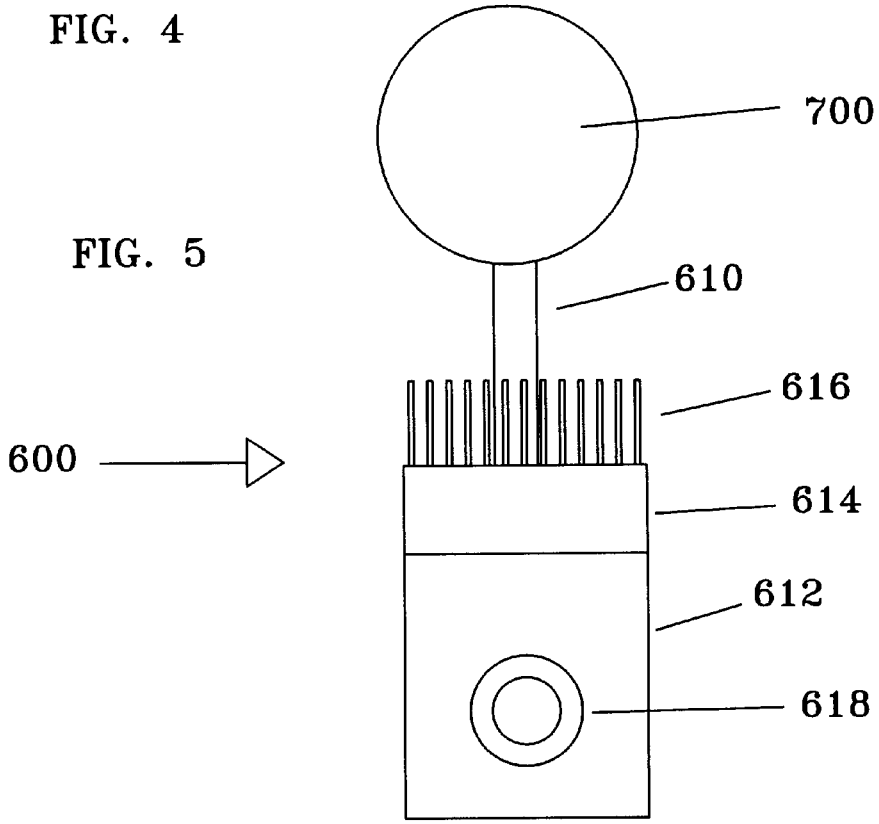
FIG. 5 is an enlarged view of the tee assembly, removed from the set-up tube.

Referring particularly to FIG. 5, it can be seen that the cylindrical slider 612 provides an outside diameter sized for travel within the set-up tube 350. A cylindrical covering of artificial turf 614, typically including artificial blades of grass 616, is carried by an upper surface of the cylindrical slider. A tee 610, typically made of a flexible material, extends above the grass 616.

A pair of diametrically opposed pivots 618 are carried by the slider 612, and extend through the vertical slots 352 defined in opposed sides of the set-up tube. The pivots 618 attach to the travel slots 320 defined in the forward end of the forward segment 310 of each of the left and right arms 302, 304. The circular motion of the travel slot 320 causes the pivot 618 to move the tee assembly in a vertically oriented, linear manner.

In a preferred version of the invention, the height of the tee 610 can be adjusted by screwing it into, or out of, the supporting cylindrical slider. In a typical embodiment, the height of the tee can be adjusted between ⅜" and 1 ⅛". This structure also allows the tee to be easily removed and replaced when damaged.

A ball set-up tube 350 is seen in FIGS. 1 through 4. The tee assembly 600 travels within the ball set-up tube 350 between an upper position, seen in FIG. 1 and a lower position, seen in FIG. 2. In the upper position, the tee assembly supports a ball ready for driving by the golfer, while in the lower position the tee assembly accepts a ball to be raised into the driving position.

The set-up tube 350 has an inside diameter that is incrementally larger than a golf ball, and is oriented vertically. An upper opening 354 allows the golf ball to extend to a position to be struck. A side opening 356 allows a golf ball to enter the set-up tube from the ball supply trough 410 when the tee assembly 600 is lowered.

A pair of opposed vertical slots 352 defined in the set-up tube allow the forward ends of the lift arms to support the tee assembly, which is carried within the set-up tube. The opposed vertical slots should be long enough to allow the upper portion of the tee to be lowered below the ball supply trough, and also to allow the tee assembly to be raised sufficiently to allow the entire tee 610 to extend from the upper opening 354 in the set-up tube.

Referring to the figures, the construction of the driving lever assembly 200 may be seen. In operation, the golfer uses a golf club to push the padded button 210 carried by an upper portion of the driving lever in the rearward direction 120, thereby providing the energy for the set-up apparatus to function. After a ball advances from the column of balls to a position on the tee, and the golfer releases the button 210, the padded button then moves in the forward direction 110.

The driving lever assembly includes a generally vertically oriented lever 216 which pivots about an approximately middle location on connector 218 which is carried by a driving lever support flange 416 or similar stationary structure. A lower portion of the lever 216 is connected by a pivoting connector 220 to a driving lever extension 250.

As seen in FIGS. 1 and 2, an upper portion of the driving lever assembly 200 carries a padded button 210 which the golfer may push with a golf club, thereby activating the apparatus 100, and setting up a golf ball. The padded button is supported on a base 212, which is attached to an upper portion of the lever 216 by a pivot 214.

A pivot arm 224 causes the base 212 to rotate about pivot 214 in such a manner as compensate for the rotation of the rotation of the lever 216, and to thereby cause the padded button 210 to point in approximately the same direction, whether the lever 216 is in the position seen in FIG. 1 or FIG. 2. An upper end of the pivot arm is attached to the base 212 at pivot 222; a lower end of the pivot arm is attached to the driving lever support flange 416 by pivot 226.

Referring to the figures, the driving lever extension is moved in the forward direction 110 as the golfer pushes on the button 210, and moves in the rearward direction 120 as the button is released, and the apparatus 100 returns to the at-rest position. The driving lever extension must be rigid, so that it can transmit force from the pivoting driving lever and cause the lift arm assembly 300 to pivot.

The driving lever extension 250 is connected at the rearward end 254 by pivot 220 to the lower portion of the driving lever arm 216, and at the forward end 252 by pivot 256 to the end of the perpendicular segment 314.

Referring to the figures, the lift arm assembly 300 pivots between an at-rest position, seen in FIG. 1, and a ball-loading position, seen in FIG. 2. As seen particularly in FIG. 4, and by comparison of FIGS. 2 and 3, the lift arm assembly comprises left and right lift arms 302, 304 which are attached at a forward location to either side of the tee assembly 600, and at a rearward location to either side of the return weight 452.

Each of the left and right lift arms includes a forward segment 310 and a rear segment 312. A pivot 318 carries each arm in a pivoting manner on the lift arm support flange 418, a fixed portion of the frame or other location. The end of the rear segment 312 of each arm 302, 304 is attached by a pivot 316 to opposed sides of the weight 452.

The forward end of each forward segment 310 defines a travel slot 320 which is attached to the diametrically opposed pivots 618 of the tee assembly. The travel slot allows the pivoting motion of the forward end of the forward segments to translate to linear motion by the tee assembly. By attaching to both sides of the tee assembly, the tee assembly is moved smoothly through the set-up tube 350, without undue wear and tear, sticking or friction.

A lift arm stop 322 is attached by fastener 324 to each lift arm 302, 304. When the lift arm is in the position seen in FIG. 1, the lift arm stop 322 is in contact with the ball supply trough 410, or alternatively any fixed object, such as the frame, thereby preventing the forward segment 310 from continuing to move upward. A preferred lift arm stop 322 is a round plug of rubber, plastic or similar material selected for quiet and desirable characteristics when contacting the ball supply trough.

A preferred lift arm stop has an off-center hole through which the fastener passes. By loosening the fastener, the stop may be turned, thereby adjusting the degree to which the top portion extends above the fastener. Thus, the degree to which the fastener and the entire lift arm assembly is allowed to rise, as seen in FIG. 1, may be fine-tuned by rotating the stop prior to tightening.

A stop plate 330 supported between the left and right lift arms supports a stop knob 334 which is adjustably carried by stop adjustment 332. As seen in FIG. 1, the stop knob contacts the bottom of the ball supply trough, frame or other fixed location, thereby stopping rotation of the lift arm assembly. The exact point at which the lift assembly is stopped can be regulated advancing or retracting the stop adjustment 332, which is typically threaded. By rotation of the stop, the distance by which it extends from the lift arm assembly may be regulated, and the point at which the lift arm assembly is stopped can therefore be controlled.

The lower portion of the each lift arm also defines a ball stop flange 326 carrying a ball stop trigger 328. As the forward segment of each lift arm moves to the position seen in FIG. 1, the left and right triggers 328 contact the left and right sides 518, 520 of the weight 516 of the ball stop assembly 500. This causes the tip 512 of the ball stop assembly to withdraw from the ball supply trough 410, thereby letting the column of balls advance.

Either of the right or left lift arms, typically the right lift arm, carries a perpendicular segment 314 which extends perpendicularly from the arm at the area of the pivot 318. An upper end of the perpendicular segment attaches at pivot 256 to the forward end of the driving lever extension 250.

Figure 4:
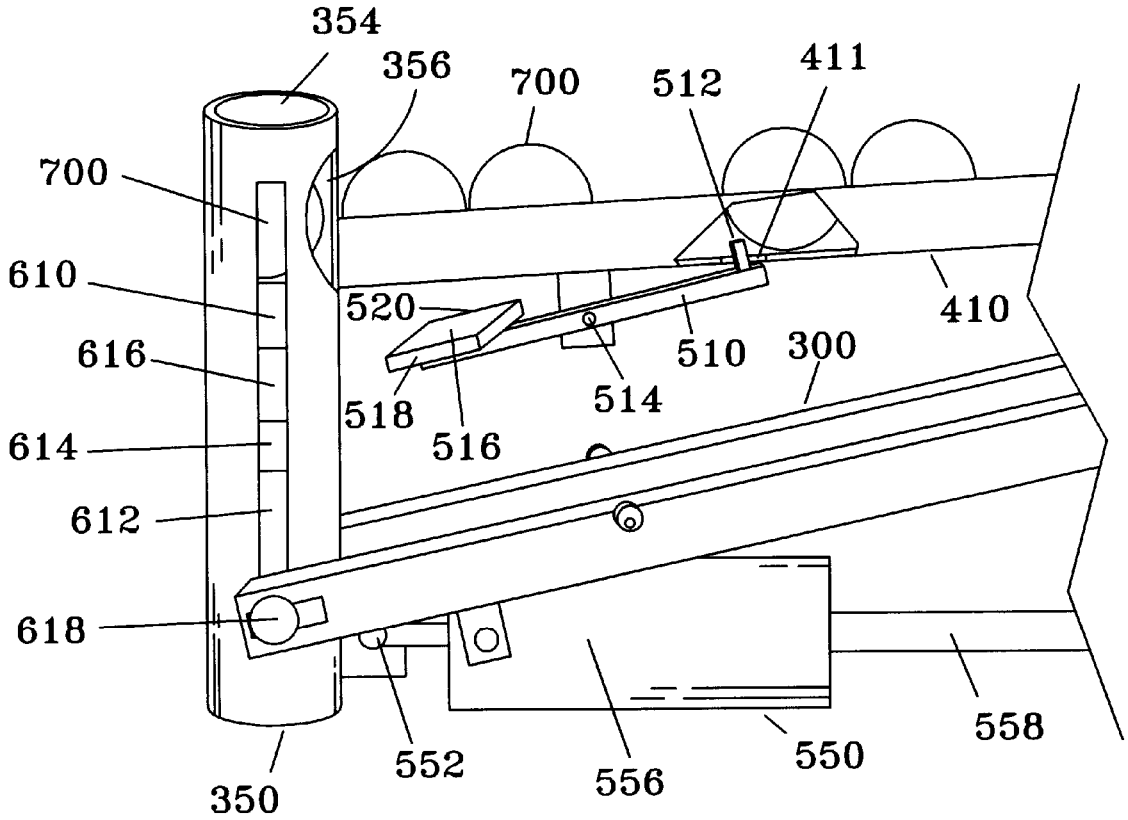
FIG. 4 is an enlarged perspective view showing the tee assembly in the lowered position.

As seen particularly in FIG. 4, the ball stop assembly 500 provides a ball stop arm 510 which pivots about a fastener 514 carried by a support flange 412. A forward end of the ball stop arm carries a weight 516 having left and right edges 518, 520 which are engaged by the left and right ball stop triggers 328 when the lift arm assembly is in the position seen in FIG. 1.

A rearward end of the ball stop arm carries a tip 512 which when inserted through the hole 411 in the base of the ball supply trough blocks the movement of the golf balls in the ball supply trough. The tip 512 and hole 411 are best seen in the cut-away view of FIG. 4.

The ball supply trough 410 provides a stream of balls from a hopper (not shown) to the side opening 356 in the set-up tube. The ball supply tube is slightly greater in inside diameter than the outside diameter of a golf ball, allowing movement of the column of balls directed toward the set-up tube.

In a preferred embodiment of the invention, the ball supply trough supports a number of brackets, flanges or frame elements that in turn support the various components comprising the golf ball set-up apparatus 100. In particular, the ball supply trough carries a lift arm support flange 418, which supports the lift arm assembly at pivot 318. A ball-stop assembly support flange 412 carries the ball stop assembly 500 at pivot 514. An air break support flange 414 carries the front arm 554 of the air break 550. A driving lever support flange 416 carries the driving lever assembly 200.

The return weight assembly 450 raises the tee assembly 600 from the low ball-loading position, seen in FIG. 1, to the high at-rest position, seen in FIG. 2. The return weight 452 is carried between the rear ends of the rear segments 312 of the left and right lift arms 302, 304 by pivots 316.

To prevent undue rotation of the weight 452, a preferred version of the return weigh assembly provides a pivot arm 454 attached to the weight at pivot 456 and to the lift arm support flange 418 at pivot 458. As seen by a comparison of FIGS. 1 and 2, it can be seen that the weight tends to turn about pivots 316, 456 in a manner that keeps the weight generally level.

The air brake assembly 550 slows the rate at which the return weight 452 drops and the rate at which the tee assembly 600 is lifted. Without the air brake, the return weight would drop rapidly and have a jarring effect that would increase wear-and-tear. Moreover, the tee assembly would rise so rapidly that the golf ball would typically fall off, or be thrown off, the tee. In operation, as the weight 452 lowers, the air brake is shortened in length, the result of the loose-fitting piston moving through the cylinder, forcing air out of a small hole in a controlled manner. Frictional resistance in the air prevents this action from happening spontaneously, and results in the weight 452 lowering, and the tee assembly rising, at a controlled rate of speed.

The air brake assembly provides an air ram 556 comprising a piston and cylinder, a forward arm 554 connected to the air break support flange 414 by forward pivot 552, and a rear arm 558 and pivot connector 560 that is carried by the air brake support bracket 336 on the lift arm assembly.

As seen in FIG. 1, the golf ball set-up apparatus is at rest, with the return weight assembly in the down position and the tee assembly in the up position. As pressure is applied to the padded button 210 of the driving lever assembly by a golf club 800, the lever 216 rotates about pivot 218, with the upper portion of the lever moving in the rearward direction 120 and the bottom of the lever moving in the forward direction. This movement causes the driving lever extension 250 to move in the forward direction, moving the perpendicular segment 314 of the lift arm assembly 300 and causing the weight 452 to rise and the tee assembly 600 to lower.

As the forward segments 310 of the left and right lift arms 302, 304 begin to lower, the ball stop trigger 328 lowers, causing the weight 516 of the ball stop assembly 500 to lower and the ball stop arm 510 to rotate about pivot 514. As the arm 510 rotates, of the tip 512 extends into the ball supply trough 410, thereby preventing the advancement of all but the first several of the column of balls.

As the forward segments of the lift arms are lowering, the piston is withdrawn from the cylinder of the air ram 556, thereby causing air to be taken in.

As the rear segments 312 of the lift arms are fully elevated, as seen in FIG. 1, the stop knob 334 makes contact with the bottom of the ball trough, stopping movement of the lift arm assembly, driving lever extension and driving lever assembly.

When the padded button is fully pushed back, and the weight 452 fully elevated, and the tee assembly fully lowered, a single golf ball 700 enters the vertical set-up tube 350 through side opening 356 and is positioned on top of the tee 610. A couple golf balls advance to take the place of the single golf ball, but the entire column of golf balls is prevented from movement by the tip 512 of the ball stop assembly 500.

The golf club is then removed from the padded button, and the weight 452 causes the rear segments 312 of the lift arm assembly to lower. Air is forced out of the ram 556 of the air brake assembly 550, which results in the elevation of the forward segments 310 of the lift arms and the tee assembly a controlled rate.

The lift arm assembly continues to elevate until the lift arm stop 322 contacts the ball trough, frame or other fixed surface. When the cylindrical slider 612 of the tee assembly fully blocks the side opening 356 of the set-up tube, the ball stop trigger 328 contacts and lifts the weight 516 of the ball stop assembly, causing the tip 512 to withdraw from the ball trough, allowing the column of balls to advance.

The golf ball carried by the tee 610 may then be hit by the golfer. With this ball gone, the golfer may obtain an additional ball by repeating the above process.

The previously described versions of the present invention have many advantages, including a primary advantage of providing a novel apparatus for golf ball set-up having a return weight lever assembly which is damped by an air brake to smoothly raise the tee assembly having a mounted golf ball.

Another advantage of the present invention is to provide a novel apparatus for golf ball set-up having a driving lever that is actuated by pressure on a padded button, and which therefore allows manual operation without bending over, scratching a club or undue waiting or delay.

A still further advantage of the present invention is to provide a novel apparatus for golf ball set-up having a lift arm assembly having left and right lift arms which lift a tee assembly in a manner that prevents binding and reduces wear and tear.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while a number of supporting flanges 410–418 have been disclosed, it is clear that any supporting structure could be used to similarly support the disclosed levers and pivots. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for golf ball set-up comprising:

(A) a driving lever pivoting on a supporting frame about a generally centrally located pivot, the driving lever movable between a first resting position in which the upper portion of the lever is extended in a forward direction, and a second position;

(B) a driving lever extension, having a rearward end attached to a lower end of the driving lever, whereby the driving lever extension moves in response to movement of the driving lever;

(C) a lift arm assembly comprising at least one arm which pivots on the supporting frame, the at least one arm pivoting at the intersection of a forward segment and a rear segment between a first resting position in which the forward end of the forward segment is raised, and a second position in which the forward end of the forward segment is lowered, the lift arm assembly being driven between the first and second positions by the forward end of the driving lever extension, which is attached to the end of a perpendicular segment carried by the at least one arm;

(D) a ball set-up tube defining diametrically opposed vertical slots oriented in a length-wise direction, an upper opening and a side opening, the ball set-up tube having an inside diameter slightly greater than a golf ball;

(E) a ball supply trough in communication with the set-up tube;

(F) a return weight, carried by the lift arm assembly, whereby the return weight biases the lift arm assembly into its resting position wherein the forward end of the forward segment is raised;

(G) a ball stop assembly movable between a first position, wherein the ball supply trough is blocked, and a second position wherein the ball supply trough is not blocked; and (H) a tee assembly movable between an upper and a lower position within the ball set-up tube by the lift arm assembly, whereby the tee assembly moves from a lower position within the set-up tube to a position wherein a tee portion of the tee assembly extends from the ball set-up tube.

2. An apparatus for golf ball set-up comprising:

(A) a driving lever carrying a padded button on an upper end and pivoting on a supporting frame about a generally centrally located pivot, the driving lever movable between a first resting position in which the upper portion of the lever is extended in a forward direction, and a second position by pushing on the padded button;

(B) a driving lever extension, having a rearward end attached to a lower end of the driving lever, whereby the driving lever extension moves in response to movement of the driving lever;

(C) a lift arm assembly comprising similar first and second arms which pivot on the supporting frame, the first and second arms pivoting at the intersection of a forward segment and a rear segment between a first resting position in which the forward end of the forward segment is raised, and a second position in which the forward end of the forward segment is lowered, the lift arm assembly being driven between the first and second positions by the forward end of the driving lever extension, which is attached to the end of a perpendicular segment carried by the first arm;

(D) a ball set-up tube defining diametrically opposed vertical slots oriented in a length-wise direction, an upper opening and a side opening, the ball supply tube having an inside diameter slightly greater than a golf ball;

(E) a ball supply trough in communication with the set-up tube;

(F) a return weight, carried by a rear portion of the rear segment of the lift arm assembly, whereby the return weight biases the lift arm assembly into its resting position wherein the forward end of the forward segment is raised;

(G) a ball stop assembly movable between a resting first position, wherein the ball supply trough is blocked, and a second position wherein the lift arm assembly engages the ball stop assembly and the ball supply trough is not blocked;

(H) an air brake assembly having one end fixed and one end carried by the lift arm assembly, whereby the air brake assembly reduces the speed at which the lift arm assembly moves; and (I) a tee assembly movable between an upper and a lower position within the ball set-up tube by the lift arm assembly, whereby the tee assembly moves from a lower position within the set-up tube to a position wherein a tee portion of the tee assembly extends from the ball set-up tube.

* * * * *